United States Patent [19]

Greene

[11] 4,444,601

[45] Apr. 24, 1984

[54] METAL ARTICLE PASSIVATED BY A BATH HAVING AN ORGANIC ACTIVATOR AND A FILM-FORMING ELEMENT

[75] Inventor: Joseph L. Greene, New Hudson, Mich.

[73] Assignee: Richardson Chemical Company, Des Plaines, Ill.

[21] Appl. No.: 457,440

[22] Filed: Jan. 11, 1983

Related U.S. Application Data

[60] Continuation of Ser. No. 278,010, Jun. 26, 1981, abandoned, which is a division of Ser. No. 72,988, Sep. 6, 1979, Pat. No. 4,298,404.

[51] Int. Cl.[3] ..... C23F 9/00

[52] U.S. Cl. ..... 148/31.5

[58] Field of Search ..... 148/31.5

[56] References Cited

U.S. PATENT DOCUMENTS

| | | | |
|---|---|---|---|
| 1,723,067 | 8/1929 | Pacz | 148/6.14 A |
| 1,798,218 | 3/1931 | Pacz | 148/6.14 A |
| 2,046,061 | 6/1936 | Curtin | 148/6.14 A |
| 2,318,559 | 5/1943 | Percival | 252/147 |
| 2,785,097 | 3/1957 | Godspeed | 148/6.14 A |
| 2,805,969 | 9/1957 | Godspeed | 148/6.14 A |
| 2,819,193 | 1/1958 | Rausch | 148/6.14 A |
| 2,935,431 | 5/1960 | Shaw | 148/6.14 A |
| 3,649,371 | 3/1972 | Tongyai | 148/6.14 A |

*Primary Examiner*—Sam Silverberg

*Attorney, Agent, or Firm*—Lockwood, Dewey, Alex & Cummings

[57] ABSTRACT

Substrates, especially those having plated metal surfaces, are subjected to passivation treatments in baths that incorporate one or more film-forming agents at least one of which does not require chromium and includes anions or cations of elements other than chromium. Typically, the anions or cations are introduced as bath-soluble salts which react with the plated surface of the substrate to form an adherent, coherent passivation surface film. Also present within these baths are a source of hydrogen ions and a bath-soluble carboxylic acid or derivative activator for enhancing the rate of the passivation reaction. Articles passivated in baths incorporating these film-forming agents have a hydrophobic surface that exhibits corrosion resistance and that typically has a bright finish.

23 Claims, No Drawings

METAL ARTICLE PASSIVATED BY A BATH HAVING AN ORGANIC ACTIVATOR AND A FILM-FORMING ELEMENT

This is a continuation of application Ser. No. 278,010, filed June 26, 1981 abandoned, which is a division of application Ser. No. 072,988, filed Sept. 6, 1979, now U.S. Pat. No. 4,298,404.

BACKGROUND AND DESCRIPTION OF THE INVENTION

This invention relates generally to improved passivation of plated metal surfaces, especially improved film-forming agents, their use in forming passive coating surfaces, and baths incorporating these film-forming agents. More particularly, this invention includes at least one agent having an element other than chromium which has been found to be an effective passivation film-forming element in an acidic bath within which passivation finishes are formed to impart corrosion resistance properties to plated metal surfaces. Such film-forming agents are particularly suitable for forming bright, decorative passive coatings on substrates plated with zinc, without having to further treat the thus passivated substrate, which coatings exhibit substantially the same type of corrosion resistance as is provided by traditional bright, decorative chromate conversion coatings.

Techniques for the passivation of plated metal surfaces have long been practiced, a particularly important technique being the formation of chromate conversion coatings onto substrates dipped into acidic baths. Such chromate conversion coatings can be applied at various thicknesses, ranging from a "blue-bright" finish which is a transparent finish having a slight blue tint and a high luster which not only imparts a corrosion-resistant coating to the surface of the substrate but also aesthetically enhances the substrate and articles made therefrom. Heavier chromate conversion coatings are considerably more protective than the bright finishes , but they do not meet the aesthetic criteria that are characteristic of the bright coatings. These heavier coatings are well recognized by their yellow, bronze or olive-drab finishes, which are listed in general order of increasing film thickness.

Other types of known treatments that are sometimes classified as forming passivation coatings include phosphating treatments and treatments which proceed with a bright dipping step that is followed by overcoating with a transparent lacquer. Although both of these treatments are chromium-free, neither is very satisfactory for enhancing the corrosion resistance of a plated substrate, especially when they are subjected to a moist environment. Each provides what can be more accurately classified as a mere barrier to corrosive conditions rather than an adhesive and cohesive film formed by chemical means between a film-forming element and the plated coating. Phosphating treatments provide barriers that can be classified as porous and will permit moisture passage to the plated coating. Phosphating treatment coatings are not bright in appearance, but provide dull, opaque paintlike overcoats that lack the aesthetic attributes of chromate conversion coatings. Treatments that coat a bright-dipped article with a transparent lacquer typically use water emulsifiable polymer coatings that will break down when wetted, whereupon moisture will penetrate to the bright dipping, which will discolor and loose its initial bright appearance.

While these other types of treatments are, on the whole, inferior to bright chromatic conversion coatings, the use of chromium in treatment baths recently has caused concern relative to chromium toxicity and related problems. For example, baths using chromium ions, especially hexavalent chromium ions, are highly toxic. Correspondingly, the chromate conversion coatings themselves may have to undergo detoxification. Likewise, rinse waters used in processing chromate conversion coatings must be subjected to elaborate chemical treatments in an effort to reduce environmental hazards presented by effluents containing chromium ions, which waste water treatments are often further complicated by chromium ion reduction and precipitation.

A need has arisen for a chromium-free or low-chromium passivation system that has the attributes of a traditional chromium conversion system which are not found in phosphating systems or in bright dipping, transparent lacquer systems. Such a chromium-free or low-chromium system should, as does a blue bright chromate conversion coating, have considerable wet strength when suitably dried and aged such that it becomes impervious and passive to moisture, handling stains, and mildly corrosive media during storage and use to the extent that the treated surface will pass a standard salt spray test for up to about 24 to 32 hours or more, while simultaneously enhancing the appearance of the substrate by imparting an attractive, brightly polished finish thereto. Such surfaces also should be more receptive to paint than the untreated plating metal.

Attempts have been made to prepare solutions for the deposition of protective surface layers on metal substrates without incorporating chromic acid by using complex fluorides of metals in cooperation with conventional oxidizing agents, as exemplified by Ries U.S. Pat. Nos. 3,539,402 and 3,539,403; Ries, et al. U.S. Pat. No. 3,682,713; and German Offenlegungsschrift No. 27 10 321.

It has now been discovered that the attributes of chromate conversion coatings can be attained in aqueous bath formulations that combine certain chromium-free film-forming agents in combination with activating agents that are carboxylic acids or derivatives thereof. If desired, these aqueous bath formulations may also contain chromium ions to the extent they will be acceptable by toxicity and environmental standards. Such formulations, which have additional advantages not typically exhibited by conventional blue bright chromate conversion coatings formulations, enhance the ability of the film-forming elements to interact with the metal surface of a substrate by a mechanism believed to be similar to that of chromium conversion techniques, in order to chemically polish and simultaneously form a passive film integral with the surface. The film-forming elements of this invention, within an environment of an acidic, aqueous passivation bath, dissolve to form this thin passive film and exhibit a rise in pH at the metal surface that is attendant to conversion coating mechanisms.

Additionally, it has been observed that bright passivation coatings in accordance with this invention have less of a tendency to "fingerprint" and also less of a tendency to develop a yellow off-color upon standing for about one or two days than do bright chromate conversion coatings. With proper maintenance and pH control, baths according to this invention have a useful life up to about twice as long as that of a conventional chromated blue-bright solution, thereby reducing the frequency of required bath dumpings. About 130 to 135 square feet of surface area can be passivated on a commercial scale for each gallon of bath prepared in accordance with this invention. Passivated articles according to this invention have a more uniformly appearing passivated surface, especially bulk-treated articles where thorough rinsing is difficult.

Bright passivation coatings according to this invention also have been found to withstand, better than most bright chromate conversion coatings, moderate handling of the coated item prior to drying, an attribute known as a good "wet hard" coating that can find useful application in barrel finishing. It has also been discovered that baths in accordance with this invention will tolerate up to 1.5 gm/l of zinc metal removed from the plated surface of the item being coated during the passivation reaction, while a typical chromate conversion coating bath will begin to yellow and cause a yellowing of the finish being formed when this level of zinc concentration is approached.

These important advantageous features are achieved in accordance with the present invention by making use of a composition including certain organic activating agents in combination with one or more film-forming agents having one or more film-forming elements within the particular class according to this invention. In an important aspect of the invention, the film-forming agent is a bath-soluble complex fluoride salt. Typically, the composition is a blended powder that is suitable for use within acidic passivation baths. The passivation treatment method in accordance with this invention includes the use of such baths, by which method the passivated articles of the present invention are produced.

Accordingly, an object of the present invention is to provide improvements in the passivation art while avoiding the need to use chromium.

Another object of the present invention is to provide a passivation system that is chromium-free or has a low chromium content and products produced thereby which are superior to those formed by phosphating treatments and by bright dipping followed by transparent lacquer coating.

Another object of the invention is to provide an adherent and coherent surface onto and with a zinc substrate, which surface is impervious and passive to moisture and withstands mildly corrosive media while providing an attractive blue bright finish.

Another object of this invention is an improved system that does not require chromium or subsequent treatments such as post-passivation with chromic solutions and products produced thereby which withstand salt spray testing conditions for up to about 24 hours or more.

Another object of the present invention is an improved blue bright finish that affords enhanced protection against handling stains after thorough drying and that also withstands moderate handling prior to drying so as to develop a good wet hard coating.

Another object of this invention is an improved passivation bath that will tolerate concentrations of zinc metal in excess of that tolerated by typical chromate conversion coating baths.

Another object of the present invention is the use of elements other than chromium as film-forming elements for acidic passivation baths.

These and other objects of this invention will be apparent from the following detailed description thereof.

Film-forming agents of the passivation baths in accordance with this invention include certain film-forming elements other than chromium in a form that is readily introduced into and dissolved within aqueous baths, the most convenient form for this purpose being that of a bath-soluble salt that incorporates the film-forming element in either the anion or the cation moiety thereof. Such salts will generally include oxides, sulfates, fluoride complexes, oxalate salt complexes, malonate salt complexes, succinate salt complexes, hydrated salts thereof, and the like.

Fluoride complexes are often to be preferred because they usually will enhance the polishing effect of the system and are beneficial in keeping certain of the metal film-forming ions in solution thereby preventing their precipitation which would tend to cloud the bath. Compounds other than the film-forming agents can incorporate such moieties into these baths, such other compounds being, for example, the bath activator or the buffering agent. Another preferred form of the film-forming agent is that of a complex oxalate salt because of the high degree of bath solubility typically exhibited by such compounds and because such salts simultaneously provide a source of carboxylic acid groups, such as oxalate groups, that are activators within the baths of this invention.

The film-forming elements themselves are characterized by being able, in an acidic aqueous bath environment, to interact with, and to form an adherent and coherent, typically bright film with the plated metal, this activity also depleting the amount of hydrogen ions within the system to thereby bring about a pH rise at the surface being passivated. It has been found that these functions and characteristics are exhibited by the following elements that are the film-forming elements of this invention: aluminum, silicon, titanium, vanadium, iron, cobalt, molybdenum, and cerium. One or more of these film-forming elements may be included in one or more of the film-forming agents. Should such be desired and tolerated by environmental standards, chromium can be used in combination with the non-chromium film-forming elements in a low-chromium passivation system according to this invention, which low-chromium systems are more tolerant of trivalent chromium than hexavalent chromium since hexavalent chromium presents particularly difficult environmental problems and also seriously hampers the effectiveness of some of the activators of this invention, for example by oxidizing the heptagluconate and oxalate ions. Chromium concentrations, economic and environmental considerations aside, may be as high as traditional maximum bath concentrations, which generally are up to about 1.5 gm/l. Significantly lower concentration may be used in accordance with this aspect of the invention, more on the order of 0.5 gm/l or lower.

Depending upon the particular bath, the metals being passivated, overall cost considerations, the additives concentrations, and the desired appearance of the film to be produced, the film-forming agents that are typically preferred include one or more of titanium, aluminum, vanadium or silicon, preferably as bath-soluble alkali metal fluoride and/or oxalate salt complexes.

Especially preferred are titanium salts. Concentrations of each film-forming agent when within a passivation bath can range between concentrations that are barely effective in forming a film, usually on the order of about 0.2 gm/l of bath and up to the solubility limit of the particular agent within the passivation bath, which is usually no higher than about 25 gm/l. Typical exemplary solubility limits are about: 25 gm/l for sodium silicofluoride, 12 gm/l for potassium titanium fluoride, 5 gm/l for sodium metavanadate, 20 gm/l for sodium orthovanadate, 2 gm/l for sodium aluminum fluoride, 3 gm/l for ceric sulfate, 4 gm/l for ferric nitrate, 5 gm/l for titanium sulfate, 5 gm/l for titanium fluoroborate and 22.5 gm/l for potassium titanium oxalate. Concentrations above these would usually not be economically advantageous, and often substantially lower concentrations are preferred. Preferably, the concentration range for these agents in general is between about 0.4 gm/l and about 6 gm/l of bath for each added film-forming agent.

Films in accordance with this invention generally will form at a commercially useful rate only in the presence of an ion which performs an oxidizing function and enhances the rate of reaction. Compounds providing such ions are often referred to as activators, which typically supply anions such as sulfate, nitrate, sulfamate, fluoride, acetate and formate, usually as salts of sodium or other alkali metals. Such traditional activators can be included in the passivation bath at concentrations for each between about 0.1 gm/l and 5 gm/l.

Suitable for use in combination with or in place of these traditional activators are the class of organic activating agents according to this invention, which can be considered to be accelerating activators that are capable of further enhancing the quality and the rate of passivation film formation beyond that provided by the traditional activators. These organic activating agents, in addition, operate in the nature of a complexing agent in order to assist in keeping the film-forming agents in solution. Such organic compounds typically take the form of carboxylic acids or their bathsoluble derivatives, usually salts, which generally have functional groups in addition to those provided by monocarboxylic acids or derivatives such as acetates or formates. Included are compounds having between about 2 and 12 carbon atoms that are polyhydroxy carboxylic acid compounds, for example heptagluconate, or polycarboxylic acid compounds such as oxalic acid, its derivatives, analogues or homologues including the oxalate, malonate, and succinate groups. Preferred are compounds of the structure: $XOOC(CH_2)_nCOOX$, wherein n is 0 or 1, and X is hydrogen, alkali metal, ammonium, or an alkali metal-transition element complex. Organic activating agents of this invention are most conveniently provided as potassium-titanium complex salts or alkali metal carboxylic acid salts. Bath concentrations range as high as 7.5 gm/l, especially for compounds having polycarboxylic acid groups such as heptagluconate, and are preferably between about 0.25 and about 4.5 gm/l of the total bath volume for the polycarboxylic or oxalic acid type of compounds.

While certain of the activators, especially those that have multiple carboxylic acid groups, can be present in the bath as a buffer to maintain a desired bath pH range while passivating large surface areas, it is often desirable to include a separate buffering agent as such within the composition. To facilitate handling of the total bath ingredient composition before incorporation into the bath, the buffering agent should be powdered, granulated, or the like and readily dissolved in an aqueous acidic bath. Boric acid is an exemplary buffering agent. It is often preferred to incorporate a boric acid source in the form of fluoroboric acid, or its ammonium or alkali metal salts because of the high bath solubility thereof and because they resist caking when stored under humid conditions, even when blended as a powdered composition with other components according to this invention. Bath concentrations generally do not have to exceed about 5 gm/l, preferably being within the range of about 0.25 to about 2.0 gm/l of bath.

It is generally preferred that the passivation composition itself, before it is incorporated into the bath according to this invention, is a powdered blend or mixture that is soluble within the acidic aqueous passivation bath. Up to about 25 grams of the composition will usually be added for each liter of passivation bath, with amounts as low as about 0.75 gm/l being effective. A typical working solution has about 1 ounce of composition per gallon of bath. Based on the weight of the composition prior to incorporation into an acidic bath, the composition typically will be composed of a combined total of between about 20 and 80 weight percent of all of the film-forming agents; between about 0 and 80 weight percent, preferably between about 10 and 70 weight percent, of the traditional activators; between about 3 and 70 weight percent, preferably between about 7 and 60 weight percent, of the accelerating organic activating agent; and between about 0 and 25 weight percent, preferably between about 2 and 30 weight percent, of a buffering agent.

Acidic aqueous passivation baths having these compositions dissolved therewithin form a passivation film upon metal substrates immersed within the bath, such baths having a hydrogen ion concentration provided by any variety of acids, although acids which have a deleterious effect upon the substrate being passivated should be avoided; for example, hydrochloric acid will generally lead to heavy etching and blackening of zinc coatings being passivated within a bath containing this acid as the source of hydrogen ions. Acceptable acids include nitric acid, sulfuric acid, sulfamic acid, phosphoric acid and the like.

In general, the bath may be supplied with an adequate hydrogen ion concentration if the acids are included within the bath at a concentration of between about 0.005 and about 0.20 molar (which is between about 0.05 and about 1.2 volume percent for nitric acid) and preferably between about 0.024 and 0.075 molar (which is between about 0.1 and about 0.5 volume percent for nitric acid), although the actual concentration of acid added to any particular bath having a film-forming composition will be dictated by the treatment time desired and by pH measurements taken within the particular bath system while it is in operation. The pH may also be controlled somewhat by the buffering agent, if present. By whatever means that the hydrogen ion concentration is varied and controlled, it is important to keep the operative pH of the bath high enough to avoid chemical polishing or etching caused by the reaction products becoming so soluble that they remain in solution rather than deposit to any significant degree as a coating on the metal surface, resulting in extremely thin coatings. Should the operative pH become too high, the rate of metal surface dissolution and coating formation will be lowered to such an extent that the reaction in effect ceases. A typical bath will have about 5.5 ml of 42° Be' nitric acid added for each gallon of bath. Noticeable passivation coating can proceed, especially in the presence of elevated temperatures, if the pH is maintained as high as 3.5. Generally, the pH range of a bath at ambient temperature should be between about 1.5 and 2.7, preferably between about 1.7 and about 2.3, most preferably between about 1.95 and about 2.3.

Any conventional passivation bath additive may also be included either in the film-forming composition or as a separate bath additive, which additives can be included, provided they are compatible with the ingredients in the bath and the formation of the type of passivation coating desired. If, under certain circumstances, environmental and toxicity considerations permit the presence of chromium ions, these can be included within these baths or within these film-forming compositions up to conventional maximum concentrations, typically between 0.12 and 1.5 gm/l, or below such concentrations when a low-chromium bath is desired and can be tolerated. Generally, trivalent chromium is more readily tolerated than hexavalent chromium as far as the environment and toxicity are concerned. Also, while trivalent chromium is substantially completely compatible with compositions and baths according to this invention, hexavalent chromium will oxidize or destroy many of the activators, although malonate groups are not so affected.

This invention also encompasses a variety of shaped articles which have attractive, bright surfaces, that afford protection against normal handling stains and mildly corrosive environments, which articles include substrates that are metal plated, the plating having been passivated by a film-forming element in accordance with this invention. Included are articles having substrates plated with zinc from one of various baths, such as cyanide baths, low-cyanide baths, alkaline non-cyanide baths, and mildly acidic baths, although zinc electrodeposition coatings from mildly acidic baths do tend to develop streaking upon passivation unless the baths in accordance with this invention are carefully formulated and monitored. Galvanized articles of zinc coated into iron pose a more difficult passivation problem with regard to uniformity of coloration, but acceptable passivated galvanized articles are included in this invention. Also capable of being passivated are subsrates of copper, aluminum, brass, peen-plated zinc, steel base plated zinc, rolled zinc foil, and zinc die cast. Articles in accordance with this invention retain their passivated attributes even when subjected to temperatures as high as 400° F.

Passivation treatments in accordance with the method aspect of this invention include preparing an aqueous acidic bath having dissolved therein one or more film-forming compositions, at least one of which does not require chromium. A strong acid is added to the bath, preferably after the film-forming composition is dissolved in the aqueous bath. In a preferred sequence, freshly zinc plated articles are rinsed with running water, are dipped in a bath of about 0.3% nitric acid to promote uniformity and to prolong passivation bath life, are rinsed with cold water, are dipped in a bath according to this invention, are rinsed in cold water, and are hot air dried.

The passivating or film-applying step is typically one of dipping the article into the acidic aqueous bath contained within stainless steel tanks or tanks of mild steel lined with Koroseal, Tygon, polypropylene or polyethylene. Alternative application procedures include spraying, brushing, swabbing, and the like. When dipping or other type of immersion into the bath is selected, the immersion time will generally be long enough to coat to the desired thickness at the passivation rate developed by the particular bath formulation. Maximum immersion times for a bright or blue bright coating will be less than that at which a yellowish or dull cast forms, usually after about 60 seconds. Generally, the immersion time as well as the subsequent transfer time will be between about 10 seconds and about 40 seconds, most often between about 15 and 25 seconds.

Typically, the film-applying step will be carried out at about room or ambient temperature, although temperatures moderately above room temperatures on the order of about 200° F. can improve the passivation rate, particularly if the bath pH is relatively high. Preferred bath temperatures are between about 70° and 90° F. As is the case with other plating or treatment baths, improved contact between the film-forming element and the surface being treated will result if the bath is subjected to some form of agitation, which improved contact can be expected to enhance overall passivation of the article.

Rinsing will usually be proceeded with in order to remove excess passivation bath from the surface of the article being treated. Typical rinsing includes running tap water over the article, although immersion in water can also be used. Usual rinse liquid temperatures will be at about ambient or room temperature, preferably a temperature close to that of the bath. Multiple rinsing steps can be carried out as needed; and, if desired, enhanced corrosion resistance can be imparted to the article by including a hydrophobic additive, such as a fluorocarbon, in one or more of the rinsing liquids. Because of the improved wet hard coating that is typically exhibited by the formulations in accordance with this invention, handling before any actual drying step is facilitated by this system when compared with other passivation systems such as those of the chromate conversion type.

One or more drying steps will accelerate hardening of the passivation film. Included in the drying steps can be one or more hot water rinses at a temperature generally below about 150° F. as well as one or more air drying steps, generally using warm air, any hot water rinse usually preceeding an air drying step.

When passivating a zinc surface, baths in accordance with this invention will tolerate up to about 1.5 gm/l of zinc metal within the bath without seriously deteriorating the bright blue finish to one that is dull or yellow. This zinc that has dissolved during bath service can be removed from the spent bath prior to its disposal by adding a base such as calcium hydroxide to raise the pH to about 9.0 to 9.5, and the resulting white solid precipitate is removed by filtration or setting.

Rates of passivation film formation will depend generally upon such factors as the desired passivating film thickness, the concentration of film-forming agent within the passivation bath, the extent of the hydrogen ion concentration, and the temperature of the bath. A typical bath for passivating a zinc plated substrate that operates at room temperature and a moderate pH within the bath operating ranges can treat about 150 square feet of surface area in about 7 to 8 minutes, while expending approximately 1 gallon of bath solution. Under such general conditions, about 1 pound of the powdered film-forming composition will provide an attractive, often blue bright, coating onto approximately 2100 square feet of electrodeposited zinc surface area. Generally speaking, a temperature increase and a hydrogen ion increase will accelerate these typical rates up to the point that such harsh conditions are developed that an acceptable blue-bright coating will not result.

The following examples are offered to illustrate the various aspects of this invention and especially the formation of bright or blue bright coatings upon zinc electrodeposited substrates within baths formulated with the powdered compositions in accordance with this invention and will also serve to illustrate the procedures that are presently preferred for practicing the method of use.

EXAMPLE 1

A powdered film-forming composition was prepared by blending together 3.7 grams of potassium titanium fluoride ($K_2TiF_6$), 0.8 gram of boric acid ($H_3BO_3$), 1.2 grams of sodium sulfate ($Na_2SO_4$), 1.0 gram of sodium nitrate ($NaNO_3$), and 1.0 gram of sodium heptagluconate ($C_7H_{13}O_8Na$). This composition was dissolved in one liter of water to which had been added 0.25 volume percent of nitric acid, the resulting solution having a pH of 1.85. A freshly zinc-plated steel panel was rinsed in water to remove adhering zinc plating solution and was then immersed in the passivation bath at room temperature for 25 seconds, after which it was removed from the solution, rinsed in cold water, and blown dry in a stream of warm air. The surface of the panel was covered by a uniform adherent blue bright film that showed definite hydrophobic characteristics and that was adequate to protect the underlying zinc surface for 24 hours in a 5% neutral salt spray in accordance with ASTM test method B-117.

EXAMPLE 2

A powdered blended mixture of 1.5 grams of sodium aluminum fluoride ($Na_3AlF_6$), 0.8 gram of boric acid, 1.2 grams of sodium nitrate, 1.0 gram of sodium sulfate, and 1.5 grams of sodium heptagluconate was dissolved in one liter of water containing 0.25 volume percent of nitric acid in order to form a bath having a pH of 1.95. Upon immersion for 25 seconds, a panel of zinc plated steel developed a pale reddish-green film that protected the underlying zinc during a 16 hour ASTM B-117 salt spray exposure.

EXAMPLE 3

The zinc surface of a panel formed a good, uniform blue bright film and was protected against an ASTM B-117 salt spray test for 16 hours upon being immersed for 25 seconds within one liter of water to which had been added 0.40 volume percent of nitric acid, together with a powdered blended mixture of 3.5 grams of sodium orthovanadate ($Na_3VO_4.16H_2O$), 3.7 grams of sodium silicofluoride ($Na_2SiF_6$), 1.0 gram of sodium heptagluconate, 1.2 grams of sodium nitrate, and 0.8 gram of boric acid, the solution having a pH of 1.7.

EXAMPLE 4

A bath was prepared by adding to water a composition consisting of 52 weight percent of potassium titanium fluoride, 11 weight percent of boric acid, 13 weight percent of sodium sulfate, 14 weight percent of sodium nitrate, and 10 weight percent of sodium oxalate ($C_2O_4Na_2$). About 0.25 weight percent of a powdered dye was also added, and the pH was adjusted to about 2.1 with nitric acid, approximately 5.5 ml of nitric acid having been added for each gallon of bath. Electroplated zinc substrates were dipped in the bath for up to about 50 seconds to provide a blue bright passivation coating on the zinc.

EXAMPLE 5

Dissolved into one liter of 0.15 volume percent nitric acid in water was a blended powder mixture of 3.1 grams of potassium titanium fluoride, 0.8 gram of boric acid, 1.0 gram of sodium sulfate, 1.0 gram of sodium nitrate, and 0.7 gram of sodium oxalate, the resulting solution having a pH of 1.96. Freshly zinc-plated steel panels that have been rinsed to remove adhering plating solution were immersed into the passivation bath, and within 15 to 20 seconds, a blue bright passivation film was formed.

EXAMPLE 6

The procedure of Example 5 was substantially repeated, except the sodium oxalate was replaced in the formulation with 0.7 gram of sodium malonate ($C_3H_2O_4Na_2$), and substantially the same result was achieved.

EXAMPLE 7

Sodium succinate ($C_4H_4O_4Na_2.6H_2O$), about 0.7 gram thereof, was used in place of the sodium oxalate of Example 5, and a substantially identical blue bright film was formed.

EXAMPLE 8

A formulation and procedure generally in accordance with Example 5 was repeated, except the sodium oxalate was replaced with 1.0 gram per liter of sodium heptagluconate, and the immersion time had to be extended to between 25 and 30 seconds to obtain a blue bright coating of substantially the same appearance.

EXAMPLE 9

Powdered formulations generally in accordance with Example 1 were dissolved in various baths employing several concentrations of acids other than nitric acid, between 0.005 molar for immersion time periods up to 5 minutes and up to 0.20 molar for immersion time periods less than one minute. The acids used were sulfuric acid, sulfamic acid, and phosphoric acid, and each of these baths produced acceptable passivation films.

EXAMPLE 10

Prepared was a powdered composition of 2 grams potassium titanium fluoride, 4 grams sodium nitrate, 2 grams sodium sulfate, 1 gram sodium oxalate, and 1 gram boric acid, which was dissolved into 1 liter of 0.15 volume percent nitric acid. An extremely thin film was formed on electroplated zinc samples, the film thinness believed to be due to the relatively low concentration of the titanium film-forming agent in this formulation.

EXAMPLE 11

Dissolved into a 1 liter bath of 0.15 volume percent nitric acid was a powdered formulation of 3.7 grams (49 weight percent) of potassium titanium fluoride, 0.8 gram (11 weight percent) of boric acid, 1 gram (13 weight percent) of sodium nitrate, 1.2 grams (16 weight percent) of sodium sulfate, and 0.8 gram (11 weight percent) of sodium oxalate. The bath thus prepared successfully passivated bright films onto peen plated zinc samples, steel base zinc plated screws, rolled zinc foil, zinc base die castings and galvanized steel samples.

EXAMPLE 12

A bath formulation was prepared including 2.5 grams per liter of sodium silicofluoride ($Na_2SiF_6$), 3.7 grams per liter of potassium titanium fluoride, 0.8 gram per liter of boric acid, 1.0 gram per liter of sodium sulfate, 1.0 gram per liter of sodium nitrate, 0.5 gram per liter of sodium heptagluconate, and 2.5 ml per liter of nitric acid, and this bath accomplished acceptable passivation of zinc plated panels.

EXAMPLE 13

A passivation bath can be prepared by dissolving, into one liter of water including 0.35 volume percent of nitric acid, the following powdered blended mixture: 3.0 grams of ceric sulfate ($Ce(SO_4)_2.4H_2O$), 3.7 grams of potassium titanium fluoride, 0.4 gram of boric acid, 1.5 grams of sodium nitrate, and about 0.5 gram of sodium heptagluconate. Into the thus prepared bath, having pH of about 1.75, can be immersed a freshly prepared zinc-plated steel panel for 20 seconds to form a bright film with bluish iridescence, which film when dried will exhibit water repellency and will protect the underlying zinc for 24 hours in accordance with ASTM B-117.

EXAMPLE 14

Zinc electroplated samples, upon being immersed for 25 seconds in a bath of 2.0 grams/liter of sodium titanium fluoride, 0.4 gram/liter of sodium sulfate, about 0.6 gm/liter sodium oxalate, and 0.20 volume percent nitric acid, and being rinsed and air dried, will form a very thin iridescent film with signs of etching the base metal in a few areas. By reducing the concentration of nitric acid to 0.15 volume percent, films of about the same character can be obtained without etching of the zinc base metal.

EXAMPLE 15

A bath is prepared to include 0.44 gram per liter of ammonium molybdate ($(NH_4)_2Mo_2O_7$), 3.7 grams per liter of potassium titanium fluoride, 1.0 gram per liter of sodium nitrate, 0.4 gram per liter of boric acid, about 1.0 gram per liter of ammonium malonate, 1.2 grams per liter of sodium sulfate, and 2.0 ml per liter of nitric acid. The presence of molybdate is believed to provide a slight yellow cast to the passivated film formed by this bath onto zinc plated panels, which protects the plating until failing a salt spray testing at about 16 hours.

EXAMPLE 16

Passivation bath formulation including 2.3 grams per liter of cobaltous sulfate heptahydrate ($CoSO_4.7H_2O$), 3.7 grams per liter of potassium titanium fluoride, 1.0 gram per liter of sodium nitrate, 1.0 gram per liter of boric acid, about 1.1 grams per liter of potassium malonate, and about 2.25 ml per liter of nitric acid will form a dark blue film onto a zinc plated substrate within 15 to 30 seconds, the film being somewhat incomplete, with cracking and flaking visible under a microscope, the cracking tendency being reducible by lowering the sulfate ion concentration from 0.815 gram per liter in the initial formulation to 0.676 gram per liter in the revised formulation, by adding 0.27 gram per liter of cobaltous carbonate, for forming a yellowed or dark blue film after an immersion for 20 seconds.

EXAMPLE 17

Films having various shades of yellow and yellow-green and showing a tendency of iridesce in sunlight are prepared upon zinc electroplated panels by immersion within a bath of 3.03 grams per liter of ceric sulfate, 3.7 grams per liter of potassium titanium fluoride, 0.8 gram per liter of boric acid, 1.0 gram per liter of sodium nitrate, about 4 grams per liter of sodium heptagluconate, and 3.5 mls per liter of nitric acid, the films completely passing ASTM test B-117 at 16 hours and showing failure at 24 hours.

EXAMPLE 18

Ammonium ferric fluoride ($(NH_4)_3FeF_6$) was prepared by reacting ferric chloride with ammonium fluoride, and 2.0 grams per liter thereof can be included in a bath with 1.9 grams per liter of potassium titanium fluoride, about 0.6 gram per liter of sodium oxalate, 1.0 gram per liter of sodium nitrate, 0.8 gram per liter of sodium sulfate, 1.0 gram per liter of boric acid and 2.5 ml per liter of nitric acid. Assorted screws and bolts, as well as zinc plated panels, are immersed therein for 25 seconds to form a blue bright film having some red areas.

EXAMPLE 19

Powdered compositions were formulated to include 14 weight percent potassium titanium fluoride, 42 weight percent potassium titanium oxalate or $TiO(C_2O_4K)_2.2H_2O$, 22 weight percent sodium fluoroborate ($Na\ B\ F_4$), 11 weight percent sodium nitrate, and 11 weight percent sodium sulfate, and such composition was added to and readily dissolved within a nitric acid aqueous bath at an operating pH of about 2.0 to produce a bath, on a per liter basis, having about 3 grams of potassium titanium oxalate, about 1 gram of potassium titanium fluoride, about 1.6 grams of sodium fluoroborate, about 0.8 gram of sodium nitrate, and about 0.8 gram of sodium sulfate. A decorative bright blue finish was formed on zinc plated panels dipped into this bath, the finish satisfactorily passing several ASTM test method B-117 salt spray tests for between 16 and 32 hours.

EXAMPLE 20

Tested was a bath having, on a per liter basis, about 4 grams of potassium titanium oxalate, about 1.6 grams of sodium fluoroborate, about 0.8 gram of sodium nitrate, and about 0.8 gram of sodium sulfate, prepared by adding a powdered composition of 56 weight percent potassium titanium oxalate, 22 weight percent sodium fluoroborate, and 11 weight percent of each of sodium nitrate and sodium sulfate, which bath passivated zinc plated panels with a cloudy, off-colored blue film that withstood ASTM B-117 salt spray tests for an average of approximately 16 hours and for as long as 32 hours.

EXAMPLE 21

A bath can be formulated to have 1.25 grams per liter ferrous sulfate ($FeSO_4.7H_2O$), 1.9 grams per liter potassium titanium fluoride, about 0.9 gram per liter of sodium malonate, 1.0 gram per liter of sodium nitrate, 1.0 gram per liter of boric acid, and 2.0 ml per liter of nitric acid. Zinc electroplated panels are immersed therein for about 20 seconds, resulting in a very yellowed film being formed on the panels.

EXAMPLE 22

A passivation film was formed on a copper substrate by immersing it in a bath prepared according to Example 19, after which it was found adequate to protect the underlying copper surface for less than 8 hours when subjected to ASTM test method B-117.

EXAMPLE 23

Aluminum samples were immsered in a bath according to Example 19, and the film formed thereon was subjected to ASTM B-117 salt spray testing and was found adequate to protect the underlying aluminum for less than 8 hours.

EXAMPLE 24

A film was formed on a brass sample by proceeding in accordance with Example 19, and it protected the underlying metal surface to the extent that it withstood ASTM test method B-117 for less than 8 hours.

While in the foregoing specification certain embodiments and examples of this invention have been described in detail, it will be appreciated that modifications and variations therefrom will be apparent to those skilled in the art; accordingly, this invention is to be limited only by the scope of the appended claims.

I claim:

1. An article having a passivated metallic surface comprising a thin adherent and coherent hydrophobic coating, said coating being a passive film integral with the metallic surface, said coating including a passivation reaction product between the metallic surface of the article and one or more film-forming agents, said metallic surface being a zinc surface, said passivation reaction product having been formed in a substantially chloride-free bath in the presence of a bath soluble organic activating agent selected from the group consisting of polyhydroxy carboxylic acids, polycarboxylic acids, derivatives thereof, and combinations thereof, at least one of said film-forming agents being a chromium-free film forming agent selected from the group consisting of flouride salts, oxalate salts, malonate salts, succinate salts, and combinations thereof, said chromium-free film-forming agent including a non-chromium film-forming element selected from the group consisting of aluminum, silicon, titanium, vanadium, iron, cobalt, molybdenum, cerium, and combinations thereof, said organic activating agent, whether added as said film-forming agent, as said organic activating agent, or as any other bath additive, is present at a concentration up to about 0.3 weight percent, expressed as oxalic acid, per volume, based on the total bath volume, and said bath includes a strong acid and has an operative pH range between values high enough to avoid chemical polishing and etching of the zinc metal surface and low enough to maintain a desired rate of passivation reaction.

2. The article of claim 1, wherein the metallic surface is a zinc plated surface and the coating is a bright passivation coating.

3. The article of claim 1, wherein the non-chromium film-forming element is selected from the group consisting of aluminum, silicon, titanium, vanadium, and combinations thereof.

4. The article of claim 1, wherein the carboxylic acid organic activating agent has between about 2 and 12 carbon atoms.

5. The article of claim 1, wherein the coating further includes a reaction product between the metallic surface and another of said film-forming agents, said another film-forming agent having chromium as a film-forming element.

6. The article of claim 1, wherein another of said film-forming agents includes chromium, said another agent being within the bath at a concentration not greater than about 0.5 gm/l, based on the total bath volume.

7. The article of claim 1, wherein said organic activating agent is present at a concentration of at least about 0.006 weight percent, expressed as oxalic acid, per volume as based on the total bath volume.

8. The article of claim 1, wherein said organic activating agent is selected from the group consisting of sodium heptagluconate; sodium oxalate; sodium malonate; potassium titanium oxalate; other alkali metal ammonium and alkali-metal transition element complex salts of heptagluconic acid, oxalic acid, succinic acid and malonic acid; and combinations thereof.

9. The article of claim 1, wherein said strong acid is selected from the group consisting of nitric acid, sulfuric acid, sulfamic acid, phosphoric acid, and combinations thereof.

10. A passivated article prepared by a method for the passivation treatment of a metallic surface, comprising:

preparing an aqueous acidic substantially chloride-free bath having dissolved therein one or more film-forming agents at least one of which is a bath-soluble chromium-free film-forming agent selected from the group consisting of fluoride salts, oxalate salts, malonate salts, succinate salts, and combinations thereof, said chromium-free film-forming agent including a non-chromium film-forming element selected from the group consisting of aluminum, silicon, titanium, vanadium, iron, cobalt, molybdenum, cerium and combinations thereof, said bath also having dissolved therein a bath soluble organic activating agent selected from the group consisting of polyhydroxy carboxylic acids, polycarboxylic acids, salts of polyhydroxy carboxylic and polycarboxylic acids, transition element complex salts of polyhydroxy carboxylic and polycarboxylic acids, esters of polyhydroxy carboxylic and polycarboxylic acids, and combinations thereof, said organic activating agent, whether added as said film-forming agent, as said organic activating agent, or as any other bath additive, is present at a concentration up to about 0.3 weight percent, expressed as oxalic acid, per volume, based on the total bath volume, said bath including a strong acid and having an operative pH range between values high enough to avoid chemical polishing and etching of the metal surface and low enough to maintain a desired rate of passivation reaction;

applying said aqueous acidic bath to a zinc surface to form a film by means of a passivation reaction between said non-chromium film-forming element and said zinc surface; and permitting said film to dry to a thin, adherent and coherent hydrophobic passivation coating.

11. The passivated article of claim 10, wherein said applying step is carried out for no more than about 60 seconds, and said dry coating is a bright passivation coating.

12. The passivated article of claim 10, wherein the film-forming element is elected from the group consisting of aluminum, silicon, titanium, vanadium, and combinations thereof.

13. The passivated article of claim 10, wherein said applying step is carried out at a pH between about 1.7 and about 2.3.

14. The passivated article of claim 10, wherein said applying step is carried out at pH between about 1.95 and 2.3.

15. The passivated article of claim 10, wherein the metallic surface is a plated zinc surface, said applying step lasts between about 10 and about 40 seconds, and the dry coating is a blue bright decorative and protective passivation coating.

16. The passivated article of claim 10, wherein said applying step is carried out at a temperature up to about 200° F.

17. The passivated article of claim 10, wherein one of said film-forming agents is a soluble complex fluoride salt.

18. The passivated article of claim 10, wherein said organic activating agent is selected from the group consisting of heptagluconic acid, oxalic acid, malonic acid, salts thereof, transition element complex salts, esters thereof, and combinations thereof.

19. The passivated article of claim 10, wherein another of said film-forming agents includes chromium.

20. The passivated article of claim 10, wherein another of said film-forming agents includes chromium, said another agent being within the bath at a concentration not greater than about 0.5 gm/l, based on the total bath volume.

21. The passivated article of claim 10, wherein said organic activating agent is present at a concentration of at least about 0.0006 weight percent, expressed as oxalic acid, per volume as based on the total bath volume.

22. The passivated article of claim 10, wherein said organic activating agent is selected from the group consisting of sodium heptagluconate; sodium oxalate; sodium malonate; sodium succinate; ammonium malonate; potassium malonate; potassium titanium oxalate; other alkali metal, ammonium and alkali-metal transition element complex salts of heptagluconate acid, oxalic acid, succinic acid and malonic acid; and combinations thereof.

23. The passivated article of claim 10, wherein said strong acid is selected from the group consisting of nitric acid, sulfuric acid, sulfamic acid, phosphoric acid, and combinations thereof.

* * * * *

UNITED STATES PATENT AND TRADEMARK OFFICE

CERTIFICATE OF CORRECTION

PATENT NO. : 4,444,601

DATED : April 24, 1984

INVENTOR(S) : Joseph L. Greene

It is certified that error appears in the above-identified patent and that said Letters Patent are hereby corrected as shown below:

At column 2, lines 41-42, change "Offenlegungsschrift No. 27 10 321" to --Offenlegungsschrift No. 27 01 321--.

At column 7, line 45, change "subsrates" to --substrates--.

At column 8, line 55, change "setting" to --settling--.

At column 15, line 2, change "elected" to --selected--.

At column 16, line 12, change "0.0006" to --0.006--.

Signed and Sealed this

*Eleventh* Day of *September 1984*

[SEAL]

*Attest:*

GERALD J. MOSSINGHOFF

*Attesting Officer*

*Commissioner of Patents and Trademarks*